United States Patent [19]

Robbins et al.

[11] 4,069,601

[45] Jan. 24, 1978

[54] THONG FOOTWEAR

[75] Inventors: Thomas Richard Robbins; Stephen Edson Cunliffe, both of San Clemente, Calif.

[73] Assignee: Young Californian Shoes, Inc., San Diego, Calif.

[21] Appl. No.: 753,640

[22] Filed: Dec. 23, 1976

[51] Int. Cl.[2] ..... A43B 3/12; A43B 13/12; A43B 13/04

[52] U.S. Cl. ..... 36/11.5; 36/30 R; 36/32 R; 36/104

[58] Field of Search ..... 36/11.5, 30 R, 32 R, 36/81, 103, 104, 43

[56] References Cited

U.S. PATENT DOCUMENTS

| | | | |
|---|---|---|---|
| 2,724,912 | 11/1955 | Silombra | 36/11.5 |
| 2,758,395 | 8/1956 | Miyaji | 36/11.5 |
| 3,300,880 | 1/1967 | Campagna | 36/104 |
| 3,345,762 | 10/1967 | Fisher et al. | 36/30 R |
| 3,739,501 | 6/1973 | Barrett | 36/11.5 |

FOREIGN PATENT DOCUMENTS

| | | | |
|---|---|---|---|
| 1,225,792 | 7/1960 | France | 36/11.5 |

*Primary Examiner*—Patrick D. Lawson
*Attorney, Agent, or Firm*—Brown & Martin

[57] ABSTRACT

An article of footwear including a platform, an upper vamp, a bottom sole and an insole. The platform includes first and second uniformly thick layers of foam rubber having a given density extending throughout the toe and heel portions of the platform, and a third layer of foam rubber having a greater density positioned between the first and second layers in the heel portion of the platform and terminating in a wedge pointing away from the heel portion for providing a platform in which the bottom surface of the platform is relatively flat and the top surface of the platform is raised in the heel portion. The upper vamp includes a thong attached to the toe portion of the platform, and side straps attached to the thong and to opposite sides of the heel portion of the platform. The side straps flare out in width from the thong to a width of at least 1½ inches where the side straps are attached to the heel portion. The bottom sole consists of crepe rubber and extends over the bottom surface of the platform. The bottom sole has a bottom surface including a tread for providing a gripping action between the article of footwear and a smooth floor. The bottom sole includes a toe segment extending upward and outward toward the top surface of the platform at the end of the toe portion and a heel segment extending upward and outward toward the top surface of the platform at the end of the heel portion. The bottom surface of the bottom sole between the toe and heel segments has a tread, and the toe and heel segments have a uniformly rough surface. The insole consists of suede leather.

9 Claims, 4 Drawing Figures

THONG FOOTWEAR

BACKGROUND OF THE INVENTION

The present invention generally pertains to footwear, and is particularly directed to making thong footwear that is comfortable to walk in.

Thong footwear is defined as an article of footwear having a platform shape to define to toe portion and heal portion, and an upper vamp having a thong attached to the toe portion of the platform and side straps attached to the thong and to opposite sides of the platform. The thong fits between the big toe and its adjacent toe and the straps fit over the top and sides of the foot to hold the footwear on the foot while walking.

Thong footwear has become quite popular in recent years beginning with rubber shower sandals, which are referred to as "Zorries". The rubber shower sandals are made of flexible rubber and have side straps that are relatively thin, much like the thong. The heel of the foot is not held close to the heel portion of the platform, and as a result the Zorries are difficult to keep on one's feet while walking.

Thong footwear has evolved from the shower room to the point where it is now a very popular form of leisure wear. The leisure thong footwear is generally more attractive in appearance. The upper vamp includes side straps made of fabric material and/or leather which are appreciably wider than the thong. The platform is relatively flat and is of uniform thickness. The platform includes one or more uniformly thick layers of either foam rubber or ethyl vinyl acetate. The insole may be made of the same material as the platform, although in some models of thong leisure footwear a grass mat is used as the insole.

The leisure thong footwear of the prior art is difficult to walk in because of the relative stiffness of the platform and because the side straps do not tend to hold the heel of the foot close enough to the heel portion of the platform while walking. Also the bottom surface of the platform is relatively smooth and does not grip the floor well.

SUMMARY OF THE PRESENT INVENTION

The present invention provides an improvement in thong footwear that makes such footwear much more comfortable to walk in. The thong footwear of the present invention provides a better gripping action with the floor; it is flexible and bends with the foot while walking; it has a raised heel to provide better foot support; and the heel of the foot is held closer to the heel of the platform.

In the article of footwear according to the present invention, the platform has a top and bottom; is shaped to define a toe portion and a heel portion; and includes a first layer of uniform thickness extending through the toe and heel portions of the platform, a second layer of uniform thickness extending through the toe and heel portions of the platform, and a third layer positioned between the first and second layers in the heel portion of the platform and terminating in a wedge pointing away from the heel portion for providing a platform in which the bottom surface is relatively flat and the top surface is raised in the heel portion. The first and second layers consist of a flexible foam rubber, having a given density, and the third layer consists of a flexible material, such as foam rubber, having a density greater than the given density of the first and second layers. The third layer must have a greater density in order to provide support in the heel portion of the platform. The combination of flexible foam rubber in these three layers provides a flexible platform, thereby providing an article of footwear that bends with the foot and is not stiff to walk in.

The upper vamp extends from the top of the platform and includes a thong attached to the toe portion of the platform, and side straps attached to the thong and to opposite sides of the heel portion of the platform. The side straps flare out in width from the thong to a width of at least 1½ inches where the side straps are attached to the heel portion. Accordingly the heel of the foot is held coser to the heel portion of the platform.

The bottom sole consists of crepe rubber or a like flexible durable, resilient, material having a bottom surface including a tread for providing a gripping action with a smooth floor. The bottom sole extends over the bottom of the platform. Preferably, the bottom sole includes a toe segment extending upward and outward toward the top surface of the platform at the end of the toe portion and a heel segment extending upward and outward toward the top surface of the platform at the end of the heel portion. Accordingly the gripping surface is extended onto those portions of the article of footwear which make initial and last contact with the floor and thus provides increased traction. The toe segment extends toward the top end of the toe portion of the platform at a uniform angle and the heel segment extends toward the top end of the heel portion of the platform at one angle in a first segment and at a greater angle in a second segment, thereby providing more gripping surface in the heel segment. It also is preferred that the bottom surface of the bottom sole has a tread between the toe and heel segments and that the toe and heel segments have a uniformly rough surface.

Preferably, the article of footwear of the present invention also includes an insole consisting of suede leather extending over the top surface of the platform, thereby providing a gripping action between the insole and the foot. Also the suede leather feels more comfortable to the foot.

DESCRIPITON OF THE PREFERRED EMBODIMENT

Figure 1:
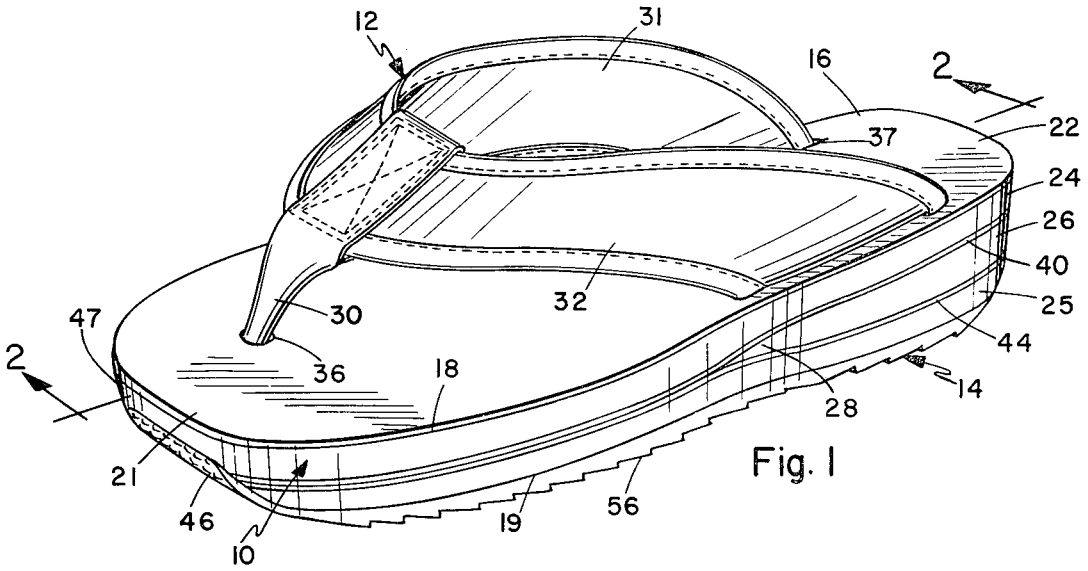
FIG. 1 is a perspective view of an article of footwear according to the present invention.
Figure 2:
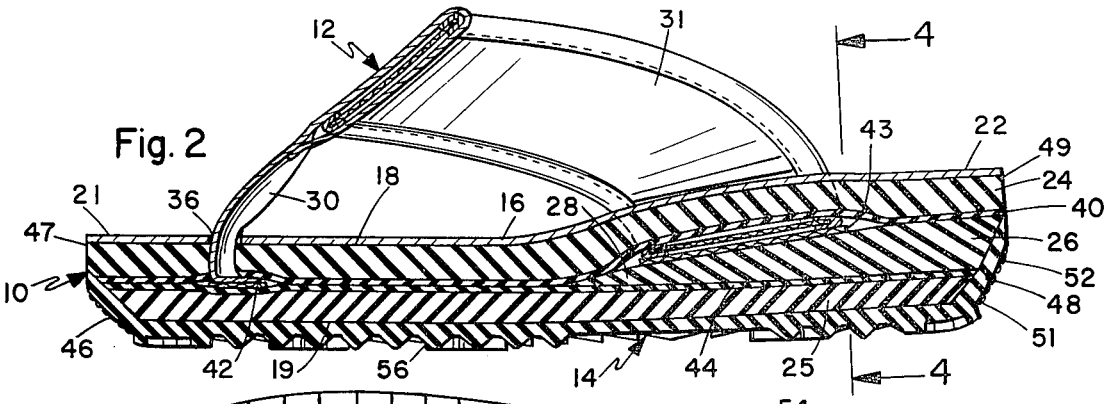
FIG. 2 is a sectional view taken along line 2—2 in FIG. 1.
Figure 3:
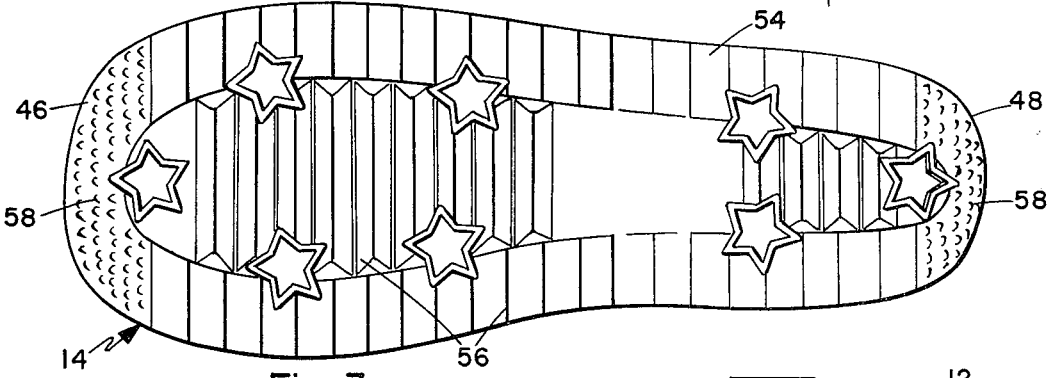
FIG. 3 is a bottom elevation view of the article of footwear shown in FIG. 1.
Figure 4:
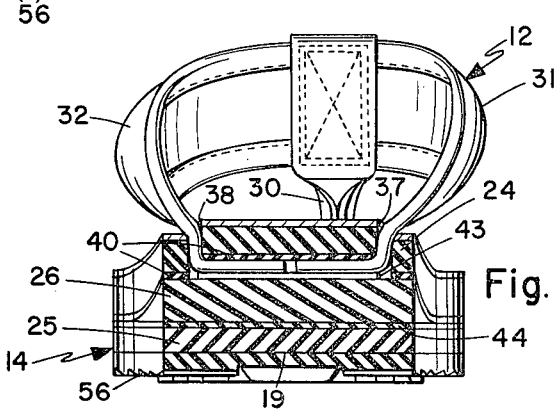
FIG. 4 is a partial sectional view of the article of footwear of FIG. 1 as taken along line 4—4 in FIG. 2.

Referring to the drawing, the preferred embodiment of an article of footwear according to the present invention include a platform 10, an upper vamp 12, a bottom sole 14 and an insole 16.

The platform 10 has a top surface 18 and a bottom surface 19. The platform 10 is shaped to define a toe portion 21 and a heel portion 22. The platform 10 includes a first layer 24, a second layer 25 and a third layer 26. The first and second layers 24 and 25 are of uniform thickness (although not necessarily the same thickness) extending throughout the toe and heel portions 21, 22 of the platform 10. The third layer 26 is positioned between the first and second layers 24 and 15 in the heel portion 22 of the platform 10 and terminates in a wedge 28 pointing away from the heel portion 22 for providing a platform 10 in which the bottom surface 19 is relatively flat and the top surface 18 is raised in the heel portion 22. The first and second layers 24 and 25 consist of flexible foam rubber having a given density and the third layer 28 consists of flexible foam rubber having a density greater than the given density of the first and second layers 24 and 25.

The upper vamp 12 extends from the top surface 18 of the platform 10. The upper vamp 12 includes a thong 30 attached to the toe portion 21 of the platform 10, and side straps 31, 32 attached to the thong 30 and to opposite sides of the heel portion 22 of the platform. The straps 31, 32 flare out in width from the thong to a width of at least one and one-half inches wide where the straps 31, 32, are attached to the heel portion 22.

The thong 30 and the side straps 31, 32, are attached to the platform 10 through openings 36, 37, and 38, and are cemented to the underside of a fourth layer 40 that is adhered to the bottom surface of the first layer 24 and also extends throughout the toe and heel portions 21, 22 of the platform 10. A plastic backed adhesive tape 42, 43 is used to reinforce the bond between the thong 30 and the straps 31, 32, and the fourth layer 40 at points where the foam rubber might tend to tear. A fifth layer 44 is adhered between the fourth layer 40 and the second layer 25 in the toe portion 21 of the platform 10, and is adhered between the second layer 25 and the third layer 26 in the heel portion 22. Both the fourth and fifth layers 40, 44 consist of flexible foam rubber having the same density as the first and second layers 24 and 25.

The bottom sole 14 consists of crepe rubber extending over the bottom surface 18 of the platform 10. The bottom sole includes a toe segment 46 extending upward and outward toward the top surface 18 of the platform 10 at the end 47 of the toe portion 21 and a heel segment 48 extending upward and outward toward the top surface 18 of the platform at the end 49 of the heel portion 22. The toe segment 46 extends toward the top end 47 of the toe portion 21 of the platform 10 at a uniform angle; and the heel segment 48 extends toward the top end 49 of the heel portion 22 of the platform 10 at one angle in a first segment 51 and at a greater angle in a second segment 52. The expression "extends toward the top end" refers to an extension in the general direction of the top end and not directly in a line that intersects with the top end. The bottom surface 54 of the bottom sole 14 has a tread 56, between the toe and heel segments 46, 48, and the toe and heel segments 46 and 48 have a uniformly rough surface 58.

The insole consists of suede split leather extending over the top surface 18 of the platform 10.

Having described our invention, we now claim:

1. An article of footwear, comprising:

a platform having a top surface and a bottom surface, and being shaped to define a toe portion and a heel portion, said platform including;

a first layer of uniform thickness extending throughout the toe and heel portion of the platform, a second layer of uniform thickness extending throughout the toe end and heel portions of the platform, and a third layer positioned between first and second layers in the heel portion for providing a platform in which the bottom of the platform is relatively flat and the top of the platform is raised in the heel portion;

wherein the first and second layers consist of a flexible foam rubber having a given density, and the third layer consists of a flexible foam rubber having a density greater than said given density; an upper vamp extending from the top surface of the platform, including;

a thong attached to the toe portion of the platform, and f side straps attached to the thong and to opposite sides of the platform; and;

a bottom sole consisting of crepe rubber extending over the bottom surface of the platform and having a bottom surface including a tread for providing a gripping action between the article of footwear and a smooth floor.

2. An article of footwear according to claim 1, wherein the side straps are attached to the heel portion of the platform and flare out in width from the thong to a width of at least 1½ inches where the side straps are attached to the heel portion.

3. An article of footwear according to claim 1, wherein the bottom sole includes a toe segment extending upward and outward toward the top surface of the platform at the end of the toe portion, and a heel segment extending upward and outward toward the top surface of the platform at the end of the heel portion.

4. An article of footwear according to claim 3, wherein the bottom surface of the bottom sole between the toe and heel segment has a tread, and the toe and heel segments have a uniformly rough surface.

5. An article of footwear, comprising:

a platform having a top surface and a bottom surface, and being shaped to define a toe portion and a heel portion, said platform including;

a first layer of uniform thickness extending throughout the toe and heel portions of the platform, a second layer of uniform thickness extending throughout the toe and heel portions of the platform, and a third layer positioned between the first and second layers in the heel portion of the platform and terminating in a wedge pointing away from the heel portion for providing a platform in which the bottom surface is relatively flat and the top surface is raised in the heel portion;

wherein the first and second layers consist of a flexible foam rubber having a density greater than said given density and the third layer consists of a flexible foam rubber having a density greater than said given density;

an upper vamp extending from the top of the platform, including;

a thong attached to the toe portion of the platform, and side straps attached to the thong and to opposite sides of the platform, and a bottom sole consisting of a flexible, durable, resilient, material extending over the bottom surface including a tread for providing a gripping action between the article of footwear and a smooth floor.

6. An article of footwear according to claim 5, wherein the bottom sole includes a toe segment extending upward and outward toward the top surface of the platform at the end of the toe portion, and a heel segment extending upward and outward toward the top surface of the platform at the end of the heel portion, and wherein the bottom surface of the bottom sole between the toe and heel segments has a tread, and the toe and heel segments have a uniformly rough surface.

7. An article of footwear according to claim 5, comprising an insole consisting of suede leather extending over the top surface of the platform.

8. An article of footwear, comprising:

a platform having a top surface and a bottom surface, and being shaped to define a toe portion and a heel portion, said platform including;

a first layer of uniform thickness extending throughout the toe and heel portion of the platform, a second layer of uniform thickness extending throughout the toe end and heel portions of the platform, and a third layer positioned between the first and second layers in the heel portion of the platform and terminating in a wedge pointing away from the heel portion for providing a platform in which the bottom surface is relatively flat and the top surface is raised in the heel portion;

wherein the first and second layers consist of flexible foam rubber having a given density, and the third layer consists of flexible foam rubber having a density greater than said given density;

an upper vamp extending from the top surface of the platform, including;

a thong attached to the toe portion of the platform, and side straps attached to the thong and to opposite sides of the heel portion of the platform, wherein the straps flare out in width from the thong to where the side straps are attached to the heel portion; and a bottom sole consisting of crepe rubber extending over the bottom surface of the platform and having a bottom surface including a tread for providing a gripping action between the article of footwear and a smooth floor;

wherein the bottom sole includes a toe segment extending upward and outward toward the top surface of the platform at the end of the heel portion, with the toe segment extending toward the top end of the toe portion of the platform at a uniform angle and the heel segment extending toward the top end of the heel portion of the platform at one angle in a first segment and at a greater angle in a second segment, and wherein the bottom surface of the bottom sole between the toe and heel segments has a tread, and the toe and heel segments have a uniformly rough surface.

9. An article of footwear according to claim 8, further comprising an insole consisting of suede leather extending over the top surface of the platform.

* * * * *